US009119425B2

(12) United States Patent
Abasova et al.

(10) Patent No.: US 9,119,425 B2
(45) Date of Patent: Sep. 1, 2015

(54) TEXTILE THIGH PROTECTOR

(71) Applicant: Freolla LLC, Staten Island, NY (US)

(72) Inventors: Gulnara Abasova, Staten Island, NY (US); Rena Abramoff, Staten Island, NY (US)

(73) Assignee: Freolla LLC, Staten Island, NY (US)

( * ) Notice: Subject to any disclaimer, the term of this patent is extended or adjusted under 35 U.S.C. 154(b) by 306 days.

(21) Appl. No.: 13/757,812

(22) Filed: Feb. 3, 2013

(65) Prior Publication Data

US 2014/0068829 A1 Mar. 13, 2014

Related U.S. Application Data

(60) Provisional application No. 61/697,896, filed on Sep. 7, 2012.

(51) Int. Cl.
*A41D 1/00* (2006.01)
*A41B 9/12* (2006.01)

(52) U.S. Cl.
CPC .... *A41D 1/00* (2013.01); *A41B 9/12* (2013.01)

(58) Field of Classification Search
CPC ..... A41B 11/14; A41B 9/12; A41B 11/00; A41B 9/00; A41C 1/00
USPC ..... 2/407, 240, 303, 409, 22, 242, 241; 450/153, 94, 100, 142, 101, 107, 108, 450/122, 124, 130, 131, 156
See application file for complete search history.

(56) References Cited

U.S. PATENT DOCUMENTS

| | | | | | |
|---|---|---|---|---|---|
| 934,214 | A | * | 9/1909 | Pervilhac | 264/212 |
| 2,114,274 | A | * | 4/1938 | Huppert | 87/7 |
| 3,228,401 | A | * | 1/1966 | Byrne | 450/114 |
| 3,489,154 | A | * | 1/1970 | Ambrose et al. | 450/97 |
| 3,496,944 | A | * | 2/1970 | Cuozzi | 450/104 |
| 3,513,842 | A | * | 5/1970 | Dennis et al. | 602/60 |

(Continued)

FOREIGN PATENT DOCUMENTS

| | | | |
|---|---|---|---|
| DE | 202010011227 | U1 | 11/2010 |
| WO | 2011131932 | A1 | 10/2011 |

OTHER PUBLICATIONS http://www.luvees.com Feb. 12, 2014.*

(Continued)

*Primary Examiner* — Danny Worrell
*Assistant Examiner* — Khaled Annis
(74) *Attorney, Agent, or Firm* — Matthew M. Hulihan, Esq.; Heslin Rothenberg Farley & Mesiti P.C.

(57) ABSTRACT

A garment for preventing inflammations of the skin between the thighs comprises first portions of the elastic tubular member which have a first thickness. Second portions of the elastic tubular member have a second thickness greater than the first thickness. The first and second portions of the elastic member have an elastic characteristic in a circumferential direction. The first and second portions of the elastic member are interspersed along the surface of the garment to promote the exposure of the thighs underneath the garment to the air. A first gripping member or members is disposed along the inner circumference of the tubular member proximate the top of the tubular member. A second gripping member or members disposed along the inner circumference of the tubular member proximate the bottom of the tubular member.

20 Claims, 13 Drawing Sheets

(56) References Cited

U.S. PATENT DOCUMENTS

| | | | | |
|---|---|---|---|---|
| 4,449,254 | A * | 5/1984 | Fogg | 2/407 |
| 4,958,388 | A * | 9/1990 | Madden, III | 2/239 |
| 5,010,597 | A * | 4/1991 | Glover | 2/242 |
| 5,143,762 | A * | 9/1992 | Ho | 428/35.7 |
| 5,418,980 | A * | 5/1995 | Kelly | 2/170 |
| 5,497,513 | A * | 3/1996 | Arabeyre et al. | 2/240 |
| 5,925,010 | A * | 7/1999 | Caprio, Jr. | 602/62 |
| 5,983,391 | A * | 11/1999 | Palmer et al. | 2/16 |
| 6,079,050 | A * | 6/2000 | Hooper-Jackson | 2/78.1 |
| 6,227,937 | B1 * | 5/2001 | Principe | 450/153 |
| 6,276,175 | B1 * | 8/2001 | Browder, Jr. | 66/171 |
| 6,588,019 | B1 * | 7/2003 | Whittle, Jr. | 2/16 |
| 7,143,453 | B2 * | 12/2006 | Duran | 2/409 |
| 7,865,970 | B2 * | 1/2011 | Giacheri | 2/22 |
| RE43,994 | E * | 2/2013 | Taylor | 428/304.4 |
| 2005/0114977 | A1 * | 6/2005 | Bodnar | 2/22 |
| 2007/0079428 | A1 * | 4/2007 | Nance et al. | 2/409 |
| 2008/0139086 | A1 * | 6/2008 | Jones | 450/100 |
| 2009/0053273 | A1 | 2/2009 | Le | |
| 2009/0113593 | A1 * | 5/2009 | Mastronardi | 2/22 |
| 2009/0235938 | A1 * | 9/2009 | Roach | 128/891 |
| 2010/0081984 | A1 * | 4/2010 | Coffinardi et al. | 602/63 |
| 2010/0107316 | A1 * | 5/2010 | Rad | 2/409 |
| 2011/0041226 | A1 * | 2/2011 | Arensdorf | 2/22 |

OTHER PUBLICATIONS http://thighslides.com/ Feb. 12, 2014.*

International Search Report and Written Opinion in related PCT Application No. PCT/US2013/056932, dated Nov. 22, 2013, 12 pages.

"Common problems with compression stockings", SelfCare Solutions, http://www.selfcare-solutions.com/difficulty-putting-on-socks-or-compression-stockings (accessed Jun. 24, 2015).

"Anyone else have Thigh High Problems?", forum at Crossdressers.com, http://www.crossdressers.com/forums/archive/index.php/t-21123.html (accessed Jun. 24, 2015).

* cited by examiner

TEXTILE THIGH PROTECTOR

CROSS REFERENCE TO RELATED APPLICATIONS

This application claims the benefit of Provisional U.S. Patent Application No. 61/697,896, filed Sep. 7, 2012, the disclosure of which is incorporated herein by reference.

TECHNICAL FIELD

The invention relates to ventilating and friction preventing clothing, made for example of a textile material, which are particularly effective for protection of the thighs and for preventing, in mild cases, chafing and, in more serious cases, miliaria or heat rash infections.

STATEMENT REGARDING FEDERALLY SPONSORED RESEARCH OR DEVELOPMENT (Not applicable)

BACKGROUND OF THE INVENTION

Rash and skin irritation between the thighs can be causes of chaffing and lead to significantly more serious conditions such as miliaria. Chaffing can occur due to friction, for example, the friction which is created when one portion of a person's skin rubs against another portion of skin. Moreover, chafing, irritation and miliaria are possible even where there is no movement. However, the most common examples of such skin to skin irritation are the result of the inner surfaces of the thighs of a person rubbing against each other during physical activity, such as walking, running or playing sports.

The likelihood of injury goes up if a person is engaging in vigorous activities, where due to the level of activity, body temperature rises and there is increased perspiration, movement and friction. In such circumstances, the amount and frequency of skin to skin contact, for example between the thighs, also rises dramatically, increasing the likelihood of friction, irritation, chafing and miliaria.

Miliaria is caused by excess perspiration that does not reach the surface of the skin. Both chaffing and miliaria can be minimized or treated by avoidance of hot bath and showers, avoidance of heat and humidity, not overdressing and wearing lightweight clothing that allows air to circulate and keep the skin cool. The present invention provides a particularly effective textile thigh protector which utilizes a number of elastic bands to keep the inventive protective device from sliding down the thighs. The result is helping to minimize and treat these types of rashes and irritations in the skin. The above objects of the invention are made possible by the inventive device providing a structure made of very light stretchy open fabric which allows air to circulate around the skin keeping it cool, preventing skin to skin contact and allowing moisture to evaporate.

There are products presently available on the market and to address the above chaffing and miliaria risks. These include Luvees Thigh Coverall offered at luvees dot com) and Thigh Slydz offered at thighslides dot com). Luvees Thigh Coverall uses a thigh band made of stretch fabric. The use of stretch fabric allows that thigh shield to stay in place. Friction appears to be prevented by providing the inner thigh portion of the shield with a pillow-like cotton inner panel to keep the thighs separated. This product suffers from the disadvantage of being unattractive. Moreover, unless excessive force is applied by this thigh shield, it may rotate out of position and cease performing the desired protective function, in so far as other portions of this thigh shield are relatively thin and accordingly result in the buildup of heat and perspiration, and provide no ventilation (because the material is relatively solid).

The Thigh Slydz thigh shield has a design whose objective is to minimize chaffing between the thighs by placing a tubular fabric member on each thigh. That fabric member is relatively impermeable and thin. Because it is provided for use under a skirt, there is no air circulating around it and, accordingly, it promotes a build up of heat and moisture. In addition, it is singularly unattractive, even though it is decorated with a bottom ribbon of lace.

SUMMARY OF THE INVENTION

In accordance with the invention, a garment to be worn by an individual for the purpose of preventing more serious inflammations and/or infections of the skin between the thighs is provided. The garment comprises a thigh protector which is worn over the thighs for protecting the thighs from irritation due to the facing surfaces of the thighs bearing and/or rubbing against each other, and/or developing conditions as a result of the lack of circulation of air or combinations of the same.

The inventive thigh protector comprises first portions of the elastic tubular member which have a first thickness. Second portions of the elastic tubular member have a second thickness. The second thickness is greater than the first thickness. The first and second portions of the elastic member have an elastic characteristic in a circumferential direction. The first and second portions of the elastic member are interspersed along the surface of the garment to promote the exposure of the thighs underneath the garment to the circulation of air. A first gripping member or members is disposed along the inner circumference of the tubular member proximate the top of the tubular member. A second gripping member or members is disposed along the inner circumference of the tubular member proximate the bottom of the tubular member. It is also noted that the inventive thigh protector may be worn in either orientation with either circumferential edge on the top, which is an advantage with potential patterns and user tastes.

The first and second gripping members may be substantially continuous bands, and may be made of silicone or any flexible and compressible gripping material, such as a rubbery material. The first and second gripping members may be made of a rubbery material having a thickness of roughly about 30 thousandths of an inch. Alternatively, the first and second gripping members are made of a rubbery material having a thickness between 10 and 50 thousandths of an inch. Yet another alternative is that the first and second members are made of a rubbery material having a thickness between 25 and 35 thousandths of an inch.

The first portions may comprise mesh fabric and the second portions may comprise embroidery-like fabric.

The first portions may have a thickness between five and 50 thousandths of an inch. The second portions may have a thickness between 5 and 100 thousandths of an inch. The second portions may have a thickness of roughly about 8 thousandths of an inch.

The elastic tubular member may be formed from a strip of elastic material formed in a loop and joined to itself to take a permanent tubular shape.

The elastic tubular member may be formed from a strip of elastic material which can be stretched circumferentially to a length one hundred and forty percent its unstretched length.

BRIEF DESCRIPTION THE DRAWINGS

The operation of the inventive textile thigh protector will become apparent from the following description taken in conjunction with the drawings, in which.

Figure 8A:
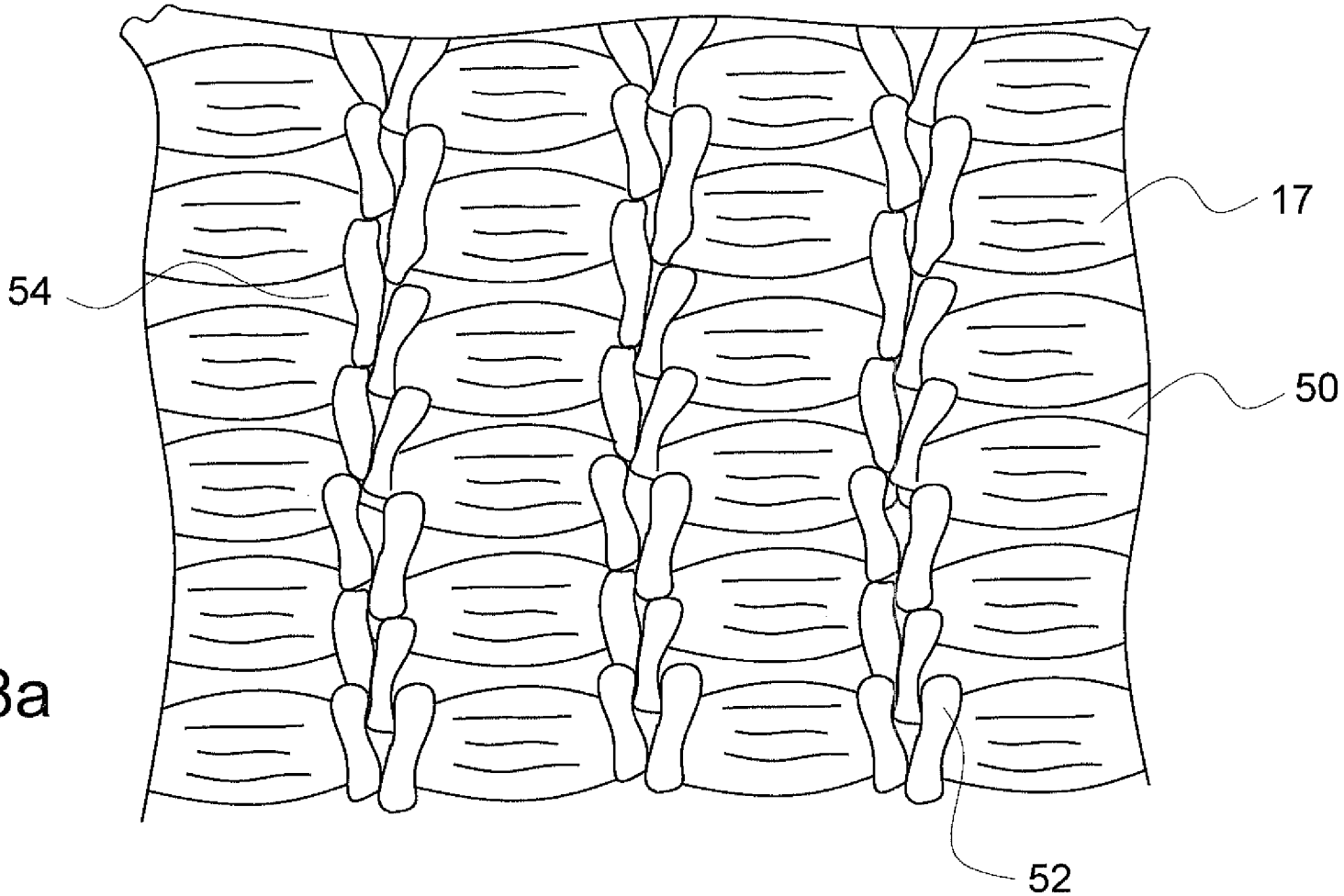
Figure 8B:
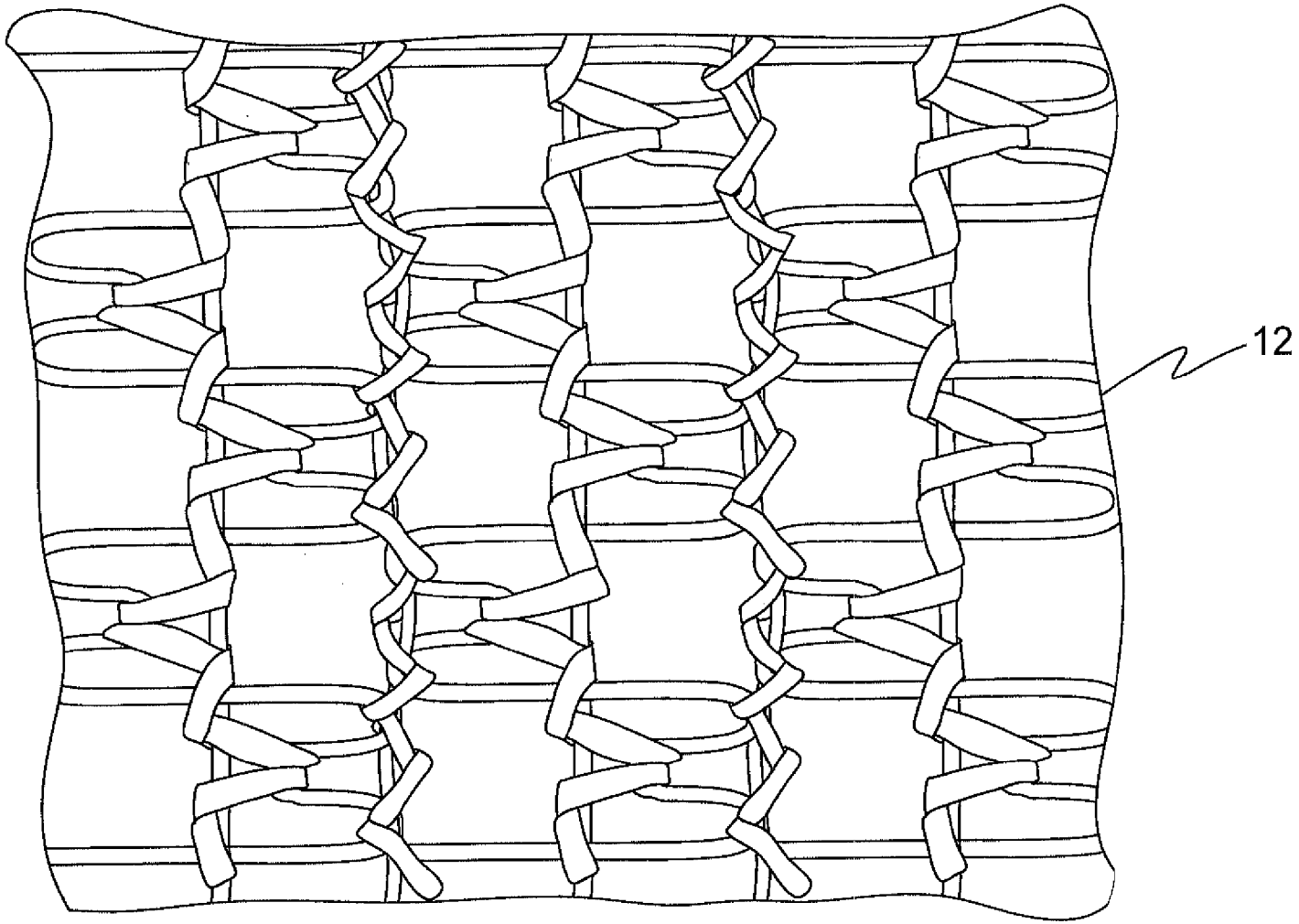
Figure 8C:
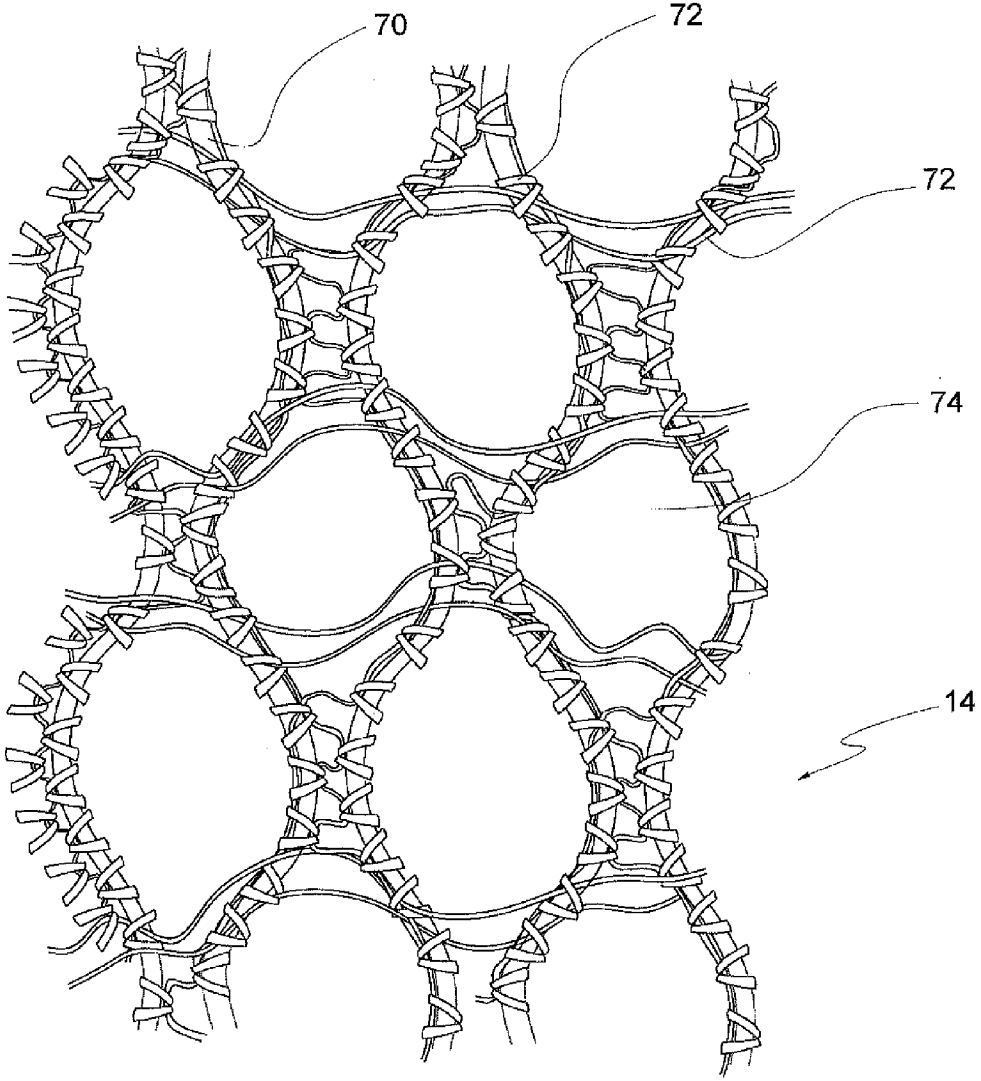
Figure 9:
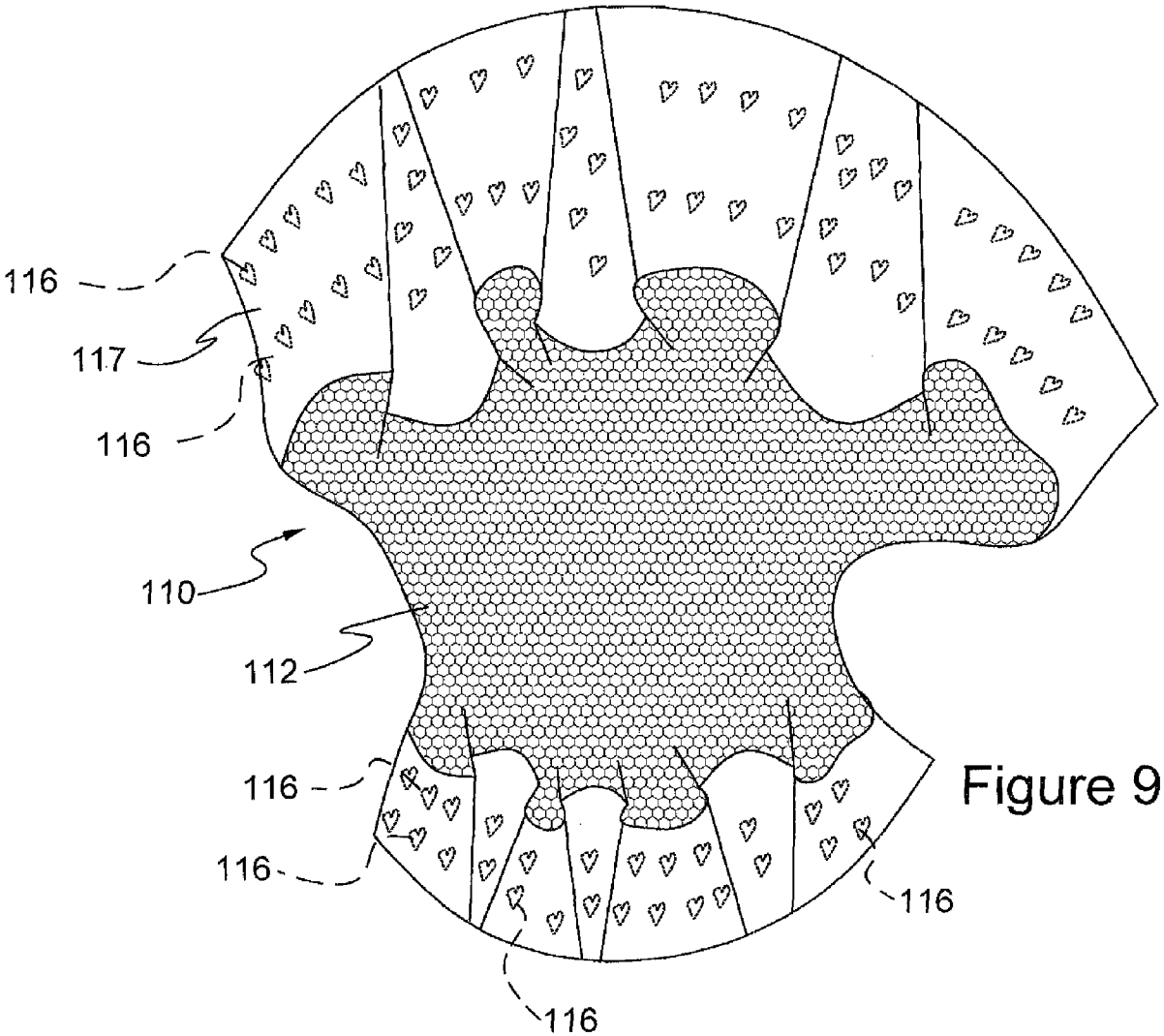
Figure 10:
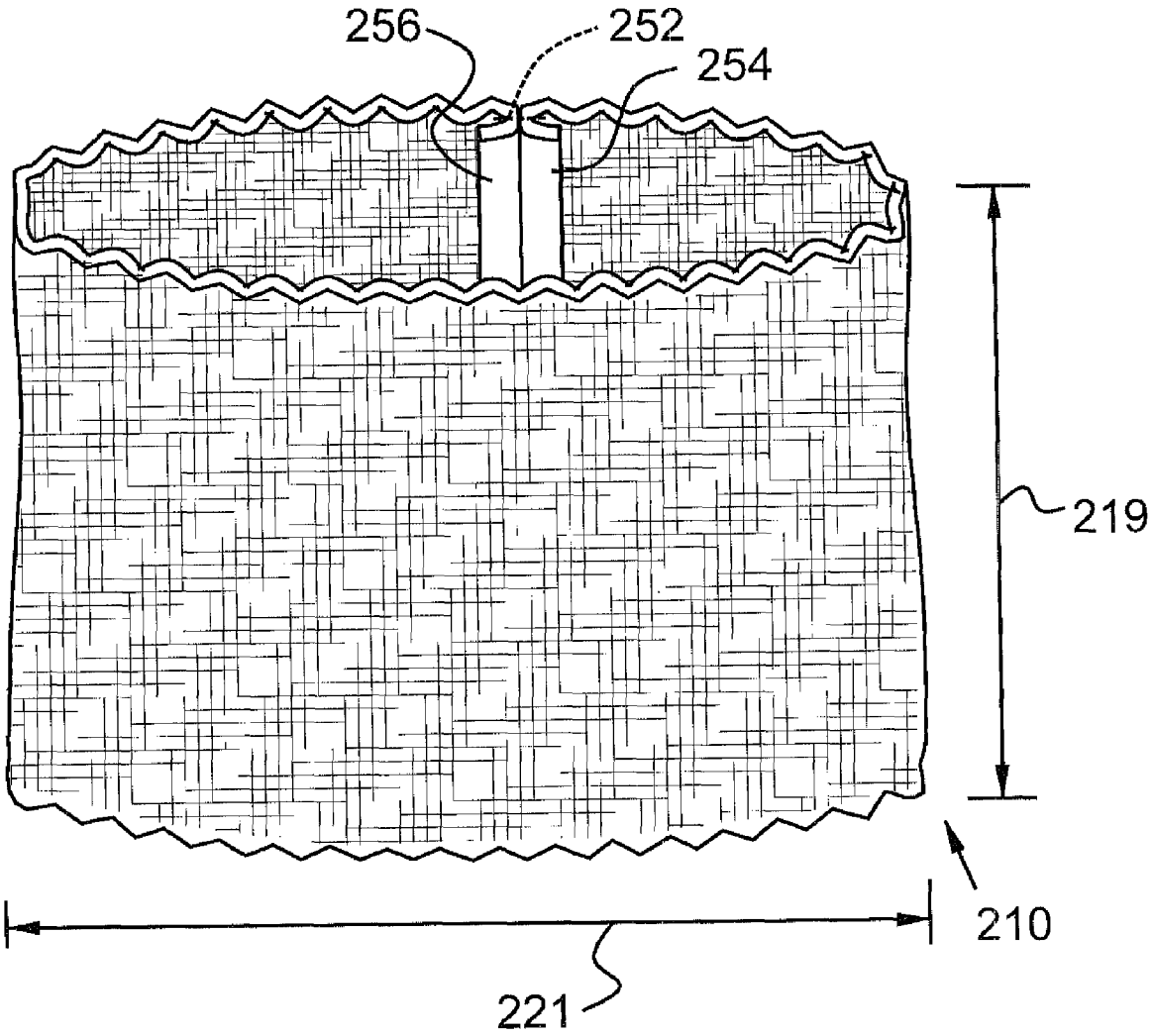
Figure 11:
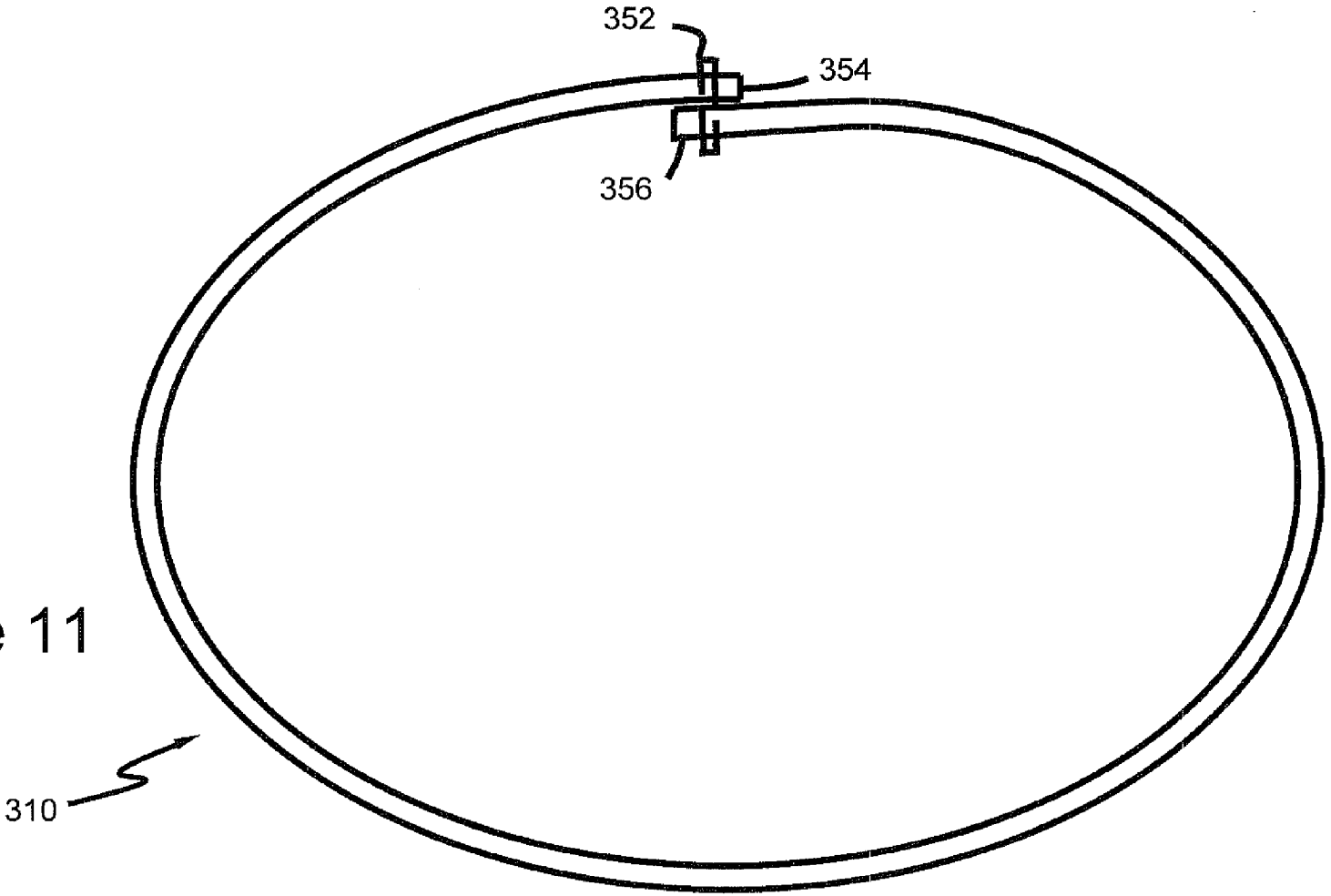
Figure 12:
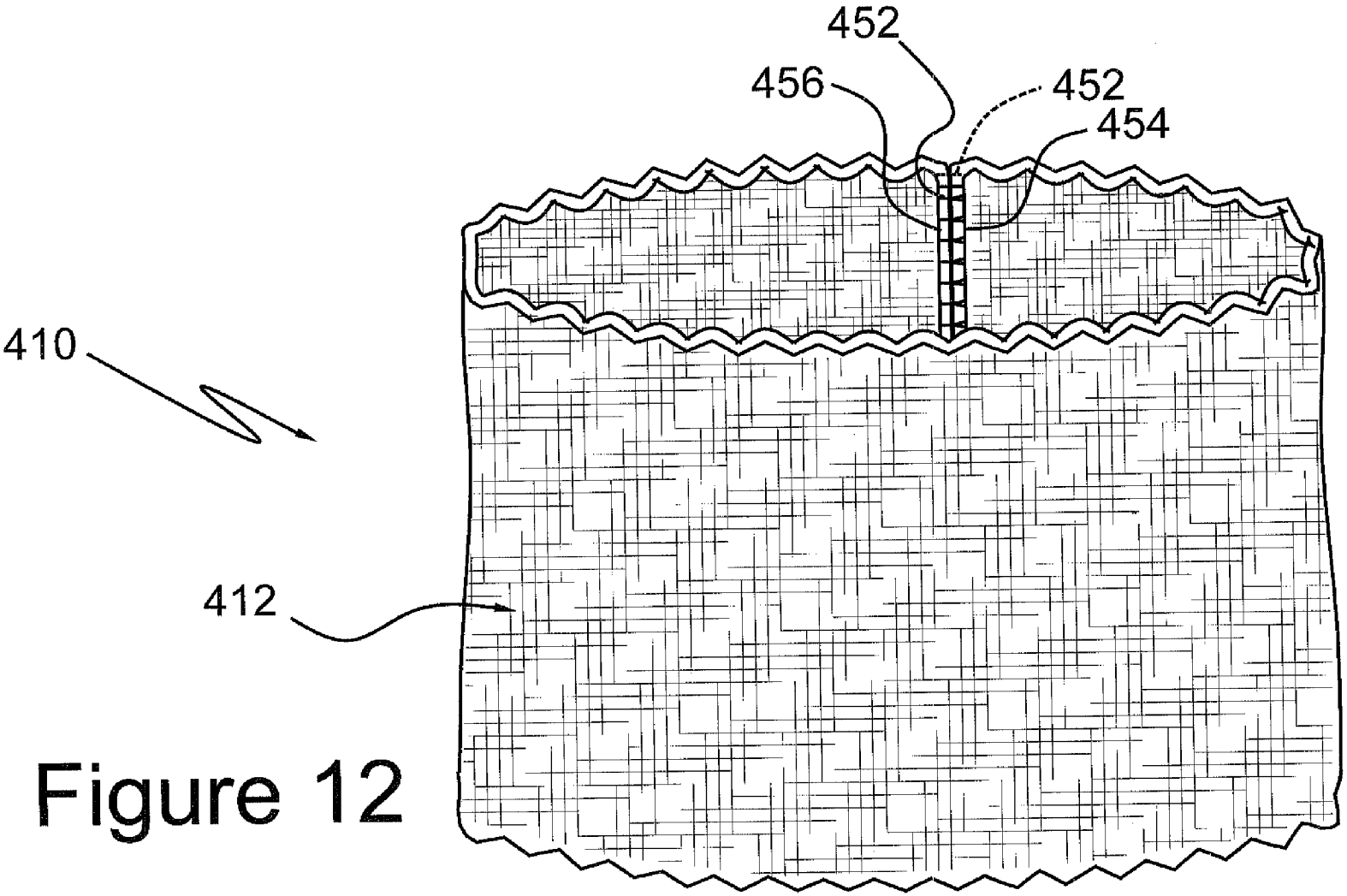
Figure 13:
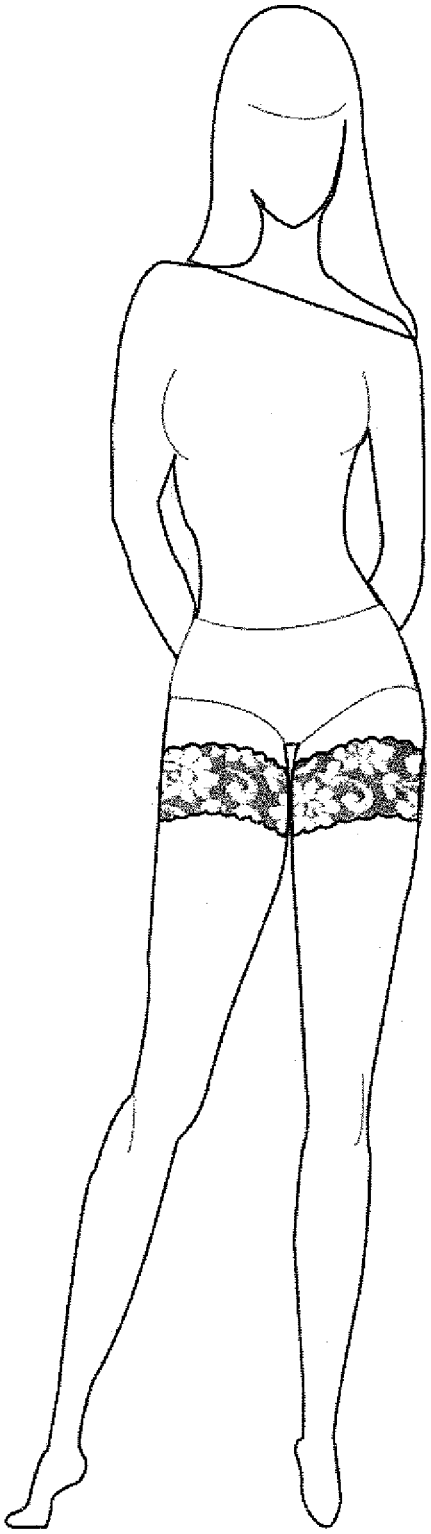
Figure 14:
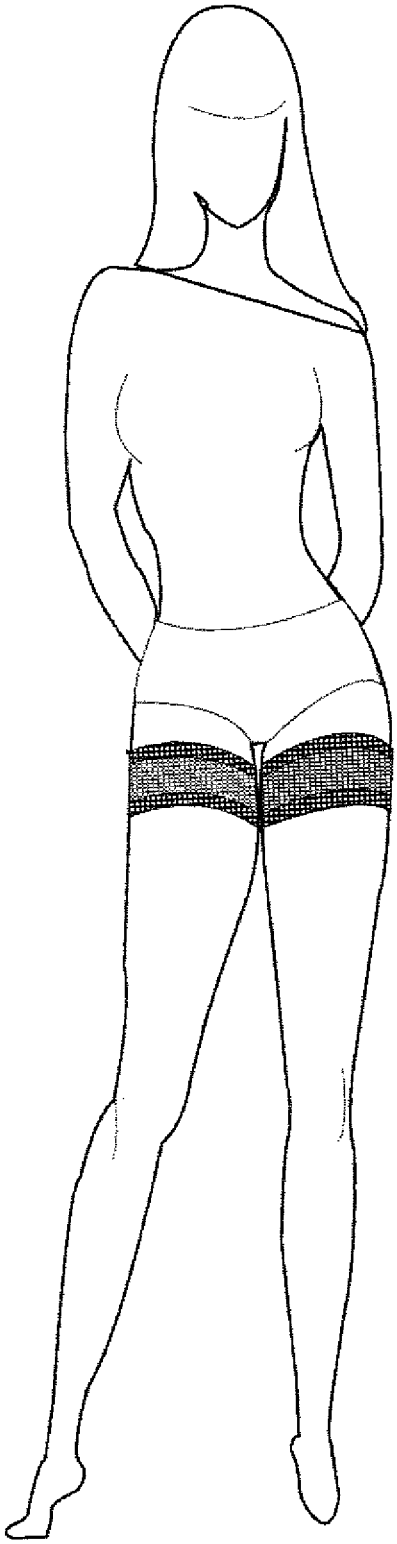

FIG. 8*a*-8*c* schematically illustrate tight meshes of stretchy fabric used in the thigh protector of the present invention;

FIG. 9 illustrates an alternative embodiment of the textile thigh protector of the present invention;

FIG. 10 illustrates another alternative embodiment of the textile thigh protector of the present invention; and FIG. 11 illustrates yet another alternative embodiment of the textile thigh protector of the present invention;

FIG. 12 is an embodiment of the invention featuring a bound edge;

FIGS. 13 and 14 show still other alternative embodiments of the invention.

DETAILED DESCRIPTION OF THE PREFERRED EMBODIMENTS

Figure 2:
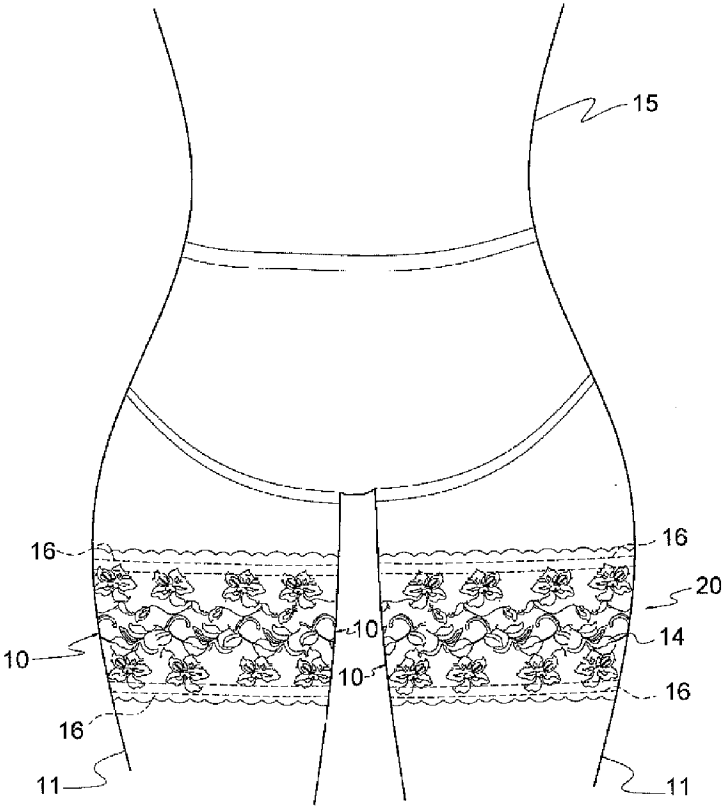
FIG. 2 is a back view of the inventive thigh protector in place on the thighs of a wearer.
Figure 1:
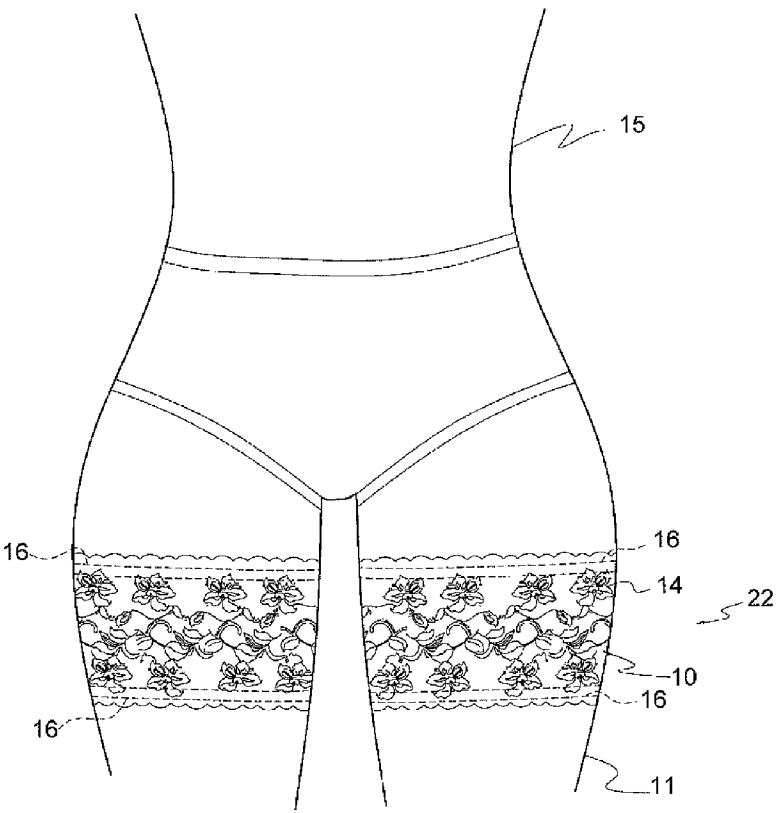
FIG. 1 illustrates from the front thigh protector garments constructed in accordance with the present invention in place on the thighs of a wearer.

Referring to FIGS. 1 and 2, a pair of the inventive thigh protectors 10 are illustrated in place on the thighs 11 of a wearer 15, as viewed from the front in FIG. 1 and from the rear in FIG. 2. As can be seen in these figures, the subject thigh protector, when viewed by an observer, appears to be a lace decoration with a configuration which does not stand out as being associated with any particular functionality or problem.

At the same time, the appearance of the individual wearing the inventive product below the protector 10 is of the wearer's bare legs not covered by stockings, as is the fashion in many circumstances. As can be seen in FIG. 1, the inventive thigh protector 10 has a generally cylindrical configuration with a circumference dimensioned to be somewhat smaller than the circumferential dimension of the thigh, but because it is made of a material capable of stretching in the circumferential direction, it will stretch over the thighs of a wearer and securely be retained in place. The elastic tubular member which comprises the inventive thigh protector is formed from an elastic material which can be stretched circumferentially to a length roughly about, for example, one hundred and forty percent its unstretched length.

Figure 3:
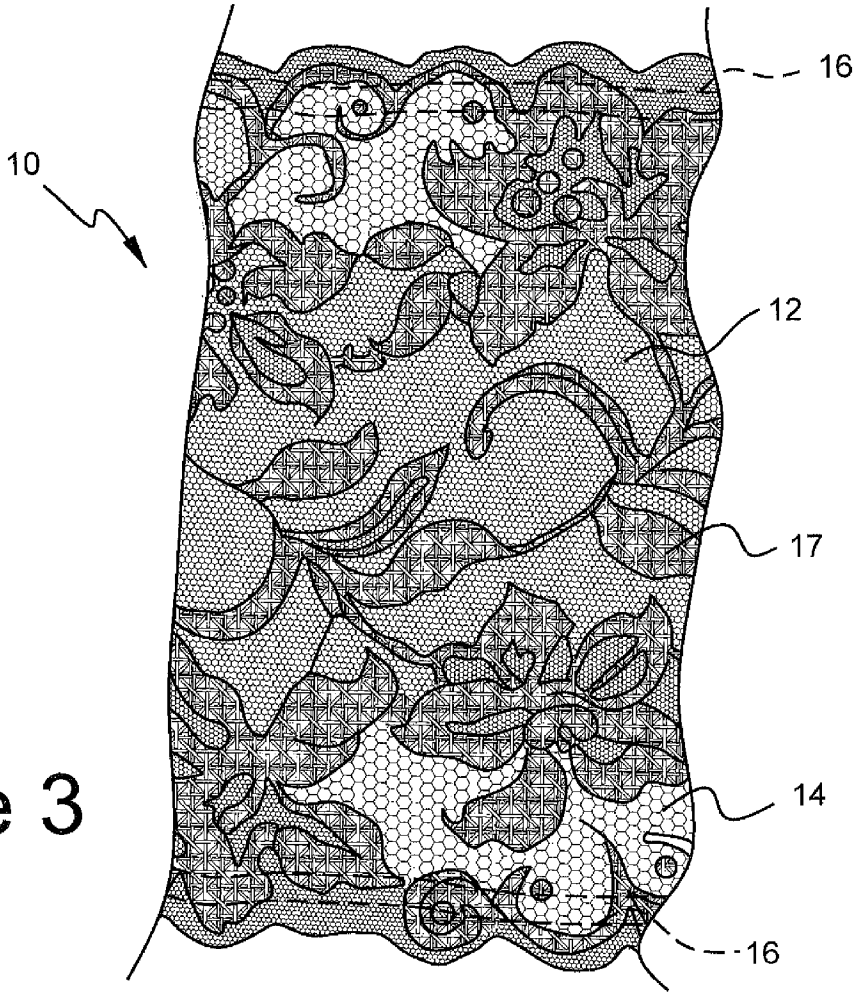
FIG. 3 illustrates schematically a portion of the inventive textile thigh protector in accordance with the present invention.

FIG. 3 illustrates a portion of the textile thigh protector 10. It is generally comprised of tight meshes of stretchy fabric with a structure similar to those used in many nylon stocking upper portions. More particularly, the inventive thigh protectors 10 comprise sections of varying air permeability and thickness. Thicker sections provide separation and relatively large passages for the release of and circulation of air. The relatively thin portions of the inventive thigh protectors provide planar spaces, particularly in the regions adjacent to the thicker portions. During movement, these planar portions provide a pumping and air circulation function.

The tight meshes of the inventive thigh protectors 10 may be made of a stretchy fabric. This stretchy fabric may be made of any suitable material or materials such as nylon fabric and polyester fabric. Cotton yarns may also be employed. However, during fabrication using multiple yarns with different coefficients of stretch, care must be taken to provide a structure with circumferential stretch so that the inventive thigh protector can be provided with the ability to stretch circumferentially to accommodate a range of thigh sizes. However, providing too much stretch will result in insufficient gripping of the thighs to achieve positional stability during use. In accordance with the invention, it is contemplated that the inventive thigh protectors will be provided in a range of sizes, for example those associated with garters. However, by increasing stretchability, it is contemplated in accordance with the invention that sufficient positional stability will be achieved throughout a range of thigh dimensions with a smaller number of sizes for the inventive garment as compared to garter sizes.

As noted above, different parts of the fabric, which makes up the inventive thigh protector, are formed with different thicknesses. For example, a section 12 of small mesh of stretchy fabric defines holes having a diameter of approximately 0.06 inches and formed of multithread constructions with a thickness on the order of about 0.008 inches. Section of meshes of stretchy fabric 12 can be made on any suitable material or materials such as nylon fabric, cotton and/or polyester fabric, provided that the desired circumferential stretch characteristic is maintained. This need for circumferential stretch his best provided and will portions of the inventive thigh protector 10, although a lack of stretch in some areas can be tolerated. On the other hand, stretch in the radial direction is not required, although it is acceptable and will usually be present given the nature of the nylon stocking top constructions which are suitable for implementation of the present invention.

Another similar section 14 is a section with a wider-holed mesh of stretchy fabric, for example a mesh defining holes with a diameter of 0.2 inches. Section 14 is made of stretchy fabric and can also be made of any suitable material or materials such as nylon fabric, cotton and polyester fabric. Fabric has a thickness in the range of about 0.008 inches.

Portion 17 may be relatively thick, for example in the range of about 0.015 inches. Thicknesses ranging between 0.005 and 0.1 inches are acceptable for the thickness of portion 17, although a range between 0.005 and 0.05 inches is preferred, with 0.01 to 0.25 inches being most preferred. Thicknesses may also vary across the face of portions 17 to provide additional ventilation. Portion 17 may be made by nylon stocking top embroidery techniques of a conventional nature, with multiyarn/multi-fiber constructions resulting in relatively thick embroidery-like textile features. An advantage of the present invention is that its entire construction may be manufactured using such existing techniques.

Figure 4:
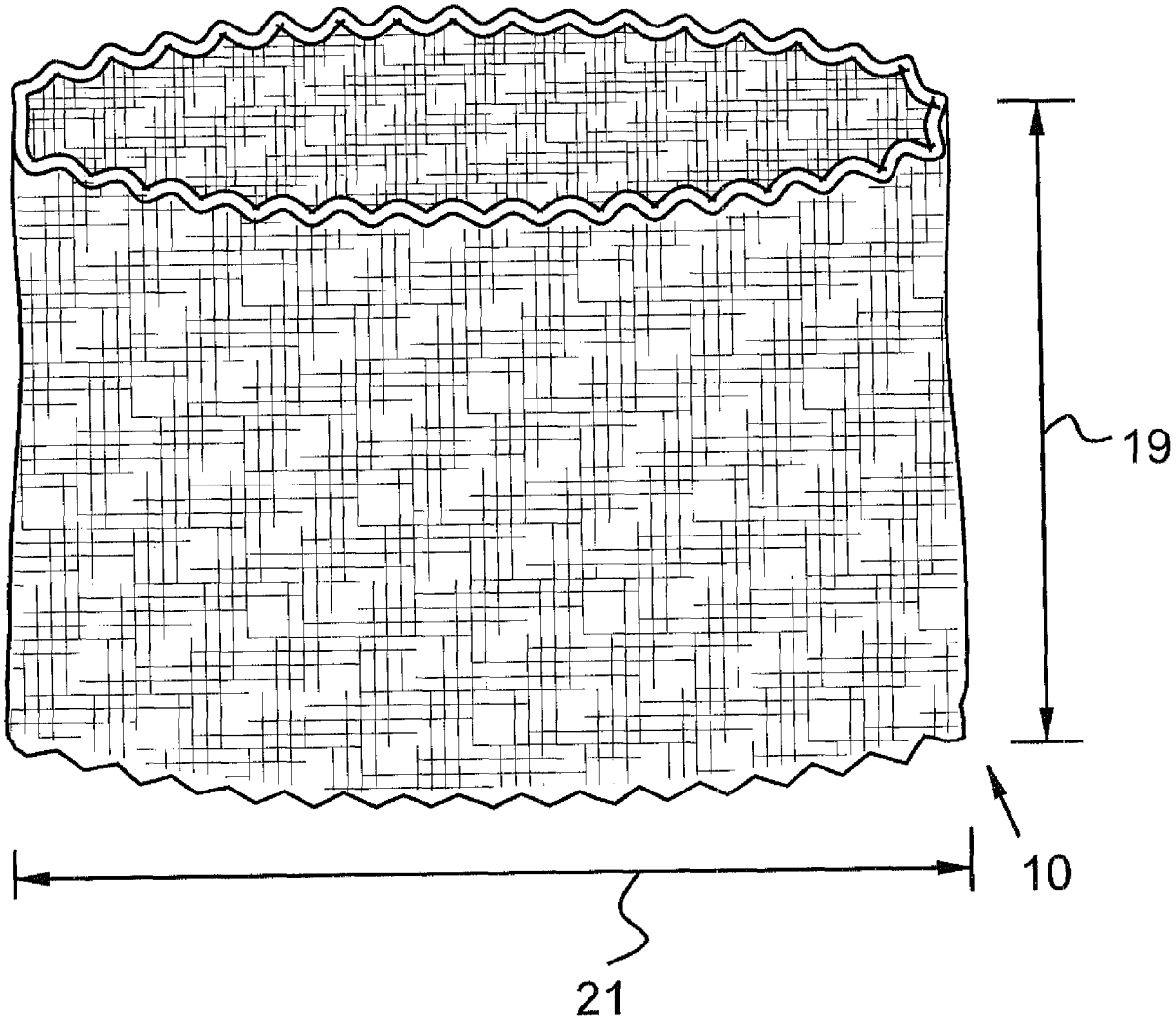
FIG. 4 is a perspective view of one embodiment of the inventive thigh protector.

In accordance with the invention, a silicone elastic gripping band 16 is employed to ensure that the textile thigh protector 10 of the present invention is maintained in place and does not slide up and down during use. Silicone elastic band 16 is made of a material selected for stretchability at least as great as the textile portions of thigh protector 10. At the same time, the material used to form silicone elastic band 16 should be compressible and provide a high degree of friction against both dry and preferably also moist skin, although it is recognized that dry skin will generally provide more. Referring to FIG. 4, thigh protector 10 has a height 19 of approximately 6.5 inches and a circumference of approximately 19 inches, corresponding to a diameter 21 of about 6 inches when held in a substantially circular configuration. In use in position on the thighs of a wearer, the circumference is larger because thigh protector 10 is being stretched. While other constructions are possible, in accordance with one preferred embodiment of the invention, thigh protector 10 may be made of a single tubular member in the manner of conventional nylon stockings. In this way, there is no seam, and this is the preferred construction.

Returning to FIGS. 1 and 2, which are front and rear views of a wearer with the inventive thigh protector 10 on the user's thighs. The maintenance of position, as noted above, is facilitated by silicon elastic bands 16 which are situated on the top and bottom of the textile thigh protector. Silicone elastic bands 16 have a thickness of approximately 0.03 inches and a width of approximately 0.5 inches wide each, although it is contemplated that widths from 0.1 through 1.2 inches will work well. A narrower range of 0.1-0.5 inches has the advantage of being minimally perceptible, but a range of 0.3 to 0.7 inches is a good compromise of stability and comfort. Silicone elastic bands 16 extend around the entire circumference of each textile thigh protector 10. However, it is not necessary for the elastic gripping band 16 to extend around the entire inner circumference of the thigh protector 10. In accordance with the invention, silicon bands 16 are formed by applying silicone in uncured form, for example by knife coating (for example, knife-over-roll, knife-over-gap/air or knife-over-blanket).

Alternatively, the gripping function may be provided by a plurality of members which may be a series of spots or other shapes of gripping material. If desired, the same may be of a decorative shape, such as hearts. For example, a ring of hearts made of silicone gripping material may extend around the inner circumference of the inventive thigh protector 10.

Figure 5:
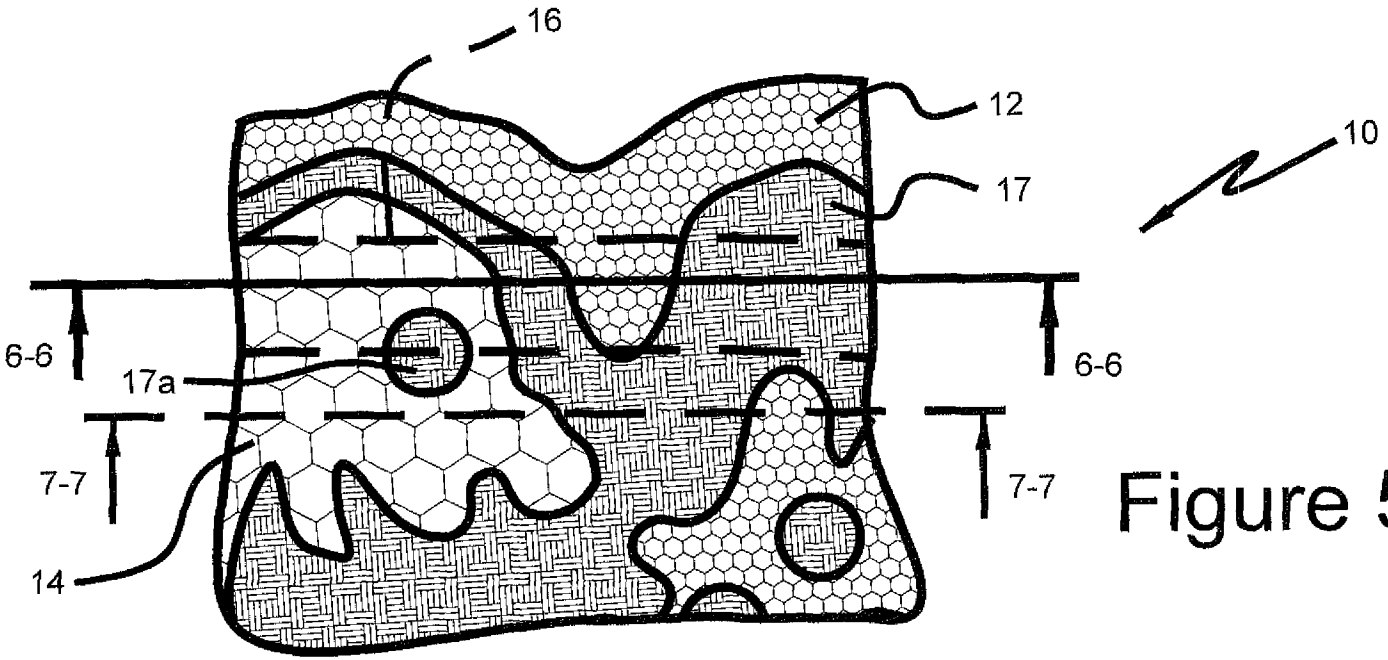
FIG. 5 is a plan view of a small portion of the fabric of the inventive thigh protector.
Figure 6:
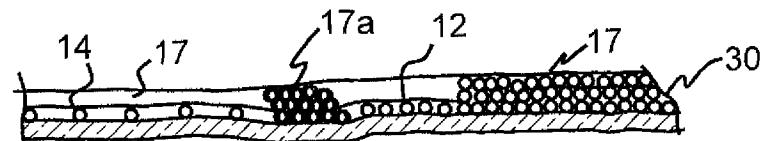
FIG. 6 is a view along lines 6-6 of FIG. 5.
Figure 7:
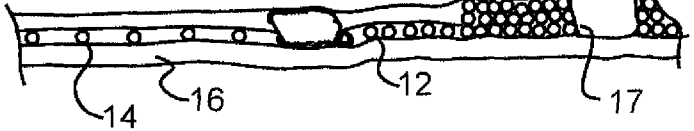
FIG. 7 is a view along lines 7-7 of FIG. 5.

With reference to FIG. 5, the inventive thigh protector 10 may be better understood. More particularly, FIG. 5 is a representation of a small portion of the inventive thigh protector 10. Referring to FIG. 5, embroidery portion 17 are seen to be relatively thick and made up of numerous individual fibers 30. In similar fashion mesh nets 12 and 14 are seen to be relatively thin in configuration. These mesh and embroidery portions may be made in numerous configurations using numerous existing techniques.

Turning to FIG. 8*a*, in one embodiment of the invention, relatively thicker portions 17 with an embroidery surface configuration are made from relatively tight meshes of fiber bundles and yarns forming a stretchy fabric 50 thicker than individual threads. Stability is maintained by binding yarn 52. The yarns and fibers are in an interlaced configuration with each other leaving relatively small spaces 54 in the mesh fabric.

With reference to FIG. 8*b*, still yet another fabric structure useful with the present invention is shown as a section of not to tight meshes of stretchy fabric. This fabric construction with lesser tight meshes is suitable for mesh portion 12.

Referring to FIG. 8*c*, it is noted that mesh portions of the inventive thigh protector may have a wide variety of configurations, such as the open mesh 70 illustrated in FIG. 8*c*, including thin mesh constructions 72 with large open holes 74. The same may be useful in implementation of the mesh area 14 of FIG. 3.

Yet another structure useful for implementation of the invention is illustrated in FIG. 9. Thigh protector 110 comprises thicker embroidered areas 117 and mesh areas 112. In this embodiment, a pair of elastic bands 116 of discrete decorative members, provide the gripping function.

With reference to FIG. 10, an elastic tubular member is formed from a strip of elastic material formed in a loop and joined to itself to take a permanent tubular shape. More particularly, thigh protector 210 may be made from a strip of embroidery like decorative stretch material having a width equal to the height 219 of thigh protector 210. The length of the strip of embroidery like material used to fabricate thigh protector 210 should be equal to the circumference of the desired final product, in other words the circumference associated with diameter 221. Such a length of stretchable embroidery material, having the ability to stretch, for example to a length approximately 40% longer than its unstretched length, is cut from a roll of piece goods. Of course, a range of stretchability is acceptable, for example materials having the ability to stretch between 110% and 180% of their unstretched length are suitable, though a range of 130% to 150% is preferred.

After the material is cut, the length of embroidery-like material, formed into a tube with the finished side facing inwardly, is sewn into a permanent configuration using stitches 252. This results in the formation of a pair of radially oriented flap-like ends 254 and 256. Ends 254 and 256 are then steam ironed to flatten them, and the finished tubular thigh protector 210 is ready to be turned finished side out and be worn.

With reference to FIG. 11, another alternative elastic tubular member is formed from a strip of elastic material formed in a loop and joined to itself to take a permanent tubular shape. More particularly, thigh protector 310 may be made from a strip embroidery like decorative stretch material and is much the same as the embodiment of FIG. 10, except that ends 354 and 356 flatly overlie each other and are sewn in this position.

FIG. 12 illustrates another alternative elastic tubular member is formed from a strip of elastic material formed in a loop and joined to itself using a stitch binding, sometimes referred to as a Merrowed edge made with stitching 452. The binding forms it into a permanent tubular shape. More particularly, thigh protector 410 may be made from a strip of embroidery like decorative stretch material 412 and is much the same as the embodiment of FIG. 10, except that ends 454 and 456 are bound to each other and are sewn in this position.

A wide variety of embroidery designs may be implemented in the invention. FIGS. 13 and 14 show such alternative embodiments of the invention.

While illustrative embodiments of the invention have been described, it is noted that various modifications will be apparent to those of ordinary skill in the art in view of the above description and drawings. Such modifications are within the scope of the invention which is limited and defined only by the following claims.

What is claimed:

1. A garment configured to be worn over a thigh of an individual for protecting the thigh from irritation due to facing surfaces of the thighs of the individual bearing or rubbing against each other, the garment comprising:

(a) an elastic tubular member having a dimension smaller than a length of the thigh of the individual and having a circumference smaller than the circumference of at least a portion of the thigh of the individual, the elastic tubular member having a top and a bottom;

(b) first portions of the elastic tubular member having a first thickness;

(c) second portions of the elastic tubular member having a second thickness, the second thickness being greater than the first thickness;

(d) the first portions and second portions of the elastic tubular member having an elastic characteristic in a circumferential direction;

(e) the first portions of the elastic tubular member being interspersed among the second portions of the elastic tubular member along a surface of the garment to promote exposure of the thigh underneath the garment to air;

(f) at least one first gripping member disposed along an inner circumference of the elastic tubular member proximate the top of the elastic tubular member; and (g) at least one second gripping member disposed along the inner circumference of the elastic tubular member proximate the bottom of the elastic tubular member.

2. The garment of claim 1, wherein the at least one first gripping member and the at least one second gripping member comprise substantially continuous bands.

3. The garment of claim 1, wherein the first portions of the elastic tubular member comprise mesh fabric.

4. The garment of claim 1, wherein the elastic tubular member comprises embroidered fabric.

5. The garment as in of claim 1, wherein the second portions of the elastic tubular member have a thickness between 5 and 100 thousandths of an inch.

6. The garment of claim 1, wherein the first portions of the elastic tubular member have a thickness between five and 50 thousandths of an inch.

7. The garment of claim 1, wherein the second portions of the elastic tubular member have a thickness of roughly about 8 thousandths of an inch.

8. The garment of claim 1, wherein the at least one first gripping member and the at least one second gripping member are made of a rubbery material.

9. The garment of claim 1, wherein the at least one first gripping member and the at least one second gripping member are made of a rubbery material having a thickness of roughly about 30 thousandths of an inch.

10. A garment configured to be worn over a thigh of an individual for protecting the thigh from irritation due to facing surfaces of the thighs of the individual bearing or rubbing against each other, the garment comprising:

(a) an elastic tubular member having a dimension smaller than a length of the thigh of the individual and having an inner circumference smaller than the circumference of at least a portion of the thigh of the individual, the elastic tubular member having a top and a bottom;

(b) the elastic tubular member having an elastic characteristic in a circumferential direction;

(c) first portions and second portions of the elastic tubular member, the first portions of the elastic tubular member being interspersed among the second portions of the elastic tubular member to promote exposure of the thigh underneath the garment to air; and (d) a gripping member disposed along the inner circumference of the elastic tubular member proximate the top of the elastic tubular member.

11. The garment of claim 10, wherein the elastic tubular member is formed from a length of elastic material having first and second elongated sides extending between first and second ends, the length of elastic material configured into a tubular form with the first end substantially flatly overlying the second end.

12. A garment configured to be worn over a thigh of an individual for protecting the thigh from irritation due to facing surfaces of the thighs of the individual bearing or rubbing against each other, the garment comprising:

(a) an elastic tubular member having a dimension smaller than a length of the thigh of the individual and having an inner circumference smaller than the circumference of at least a portion of the thigh of the individual, the elastic tubular member having a top and a bottom;

(b) first portions of elastic tubular member having a first thickness;

(c) second portions of the elastic tubular member having a second thickness, the second thickness being greater than the first thickness;

(d) the first portions and second portions of the elastic tubular member having an elastic characteristic in a circumferential direction;

(e) the first portions and second portions of the elastic tubular member being configured to promote exposure of the thigh underneath the garment to air, wherein the greater thickness of the second portions provides separation and passages between the garment and the thigh underneath the garment for release or circulation of air proximate the first portions of the elastic tubular member; and (f) at least one gripping member disposed along the inner circumference of the elastic tubular member.

13. The garment of claim 12, wherein the at least one gripping member includes a substantially continuous band.

14. The garment of claim 13, wherein the elastic tubular member comprises embroidered fabric.

15. The garment of claim 14, wherein the second portions have a thickness between 5 and 100 thousandths of an inch.

16. The garment of claim 15, wherein the second portions have a thickness of roughly about 8 thousandths of an inch.

17. The garment of claim 16, wherein the at least one gripping member is made of a rubbery material having a thickness of roughly about 30 thousandths of an inch.

18. The garment of claim 1, wherein the at least one gripping member is made of a rubbery material having a thickness between 10 and 50 thousandths of an inch.

19. The garment claim 12, wherein the elastic tubular member is formed from a strip of elastic material formed in a loop and joined to itself to take a permanent tubular shape.

20. The garment of claim 12, wherein the elastic tubular member is formed from a strip of elastic material configured to stretch circumferentially to a length at least one hundred and forty percent its unstretched length.

* * * * *

UNITED STATES PATENT AND TRADEMARK OFFICE

CERTIFICATE OF CORRECTION

PATENT NO. : 9,119,425 B2
APPLICATION NO. : 13/757812
DATED : September 1, 2015
INVENTOR(S) : Abasova et al.

It is certified that error appears in the above-identified patent and that said Letters Patent is hereby corrected as shown below:

In the Claims

Column 7, Line 19: Claim 5, Delete "as in"

Signed and Sealed this
Fifth Day of July, 2016

Michelle K. Lee

Michelle K. Lee
*Director of the United States Patent and Trademark Office*